United States Patent [19]

Burns

[11] Patent Number: 4,938,349

[45] Date of Patent: Jul. 3, 1990

[54] PROTECTIVE TUBE FOR A GOLF CLUB SHAFT

[76] Inventor: Paul H. Burns, 831 Livernois, Ferndale, Mich. 48220

[21] Appl. No.: 355,751

[22] Filed: May 22, 1989

[51] Int. Cl.[5] ..... A63B 55/00; A63B 55/04; A63B 55/06

[52] U.S. Cl. ..... 206/315.6

[58] Field of Search ..... 206/315.2, 315.3, 315.4, 206/315.5, 315.6, 315.7, 315.8; 150/159, 160

[56] References Cited

U.S. PATENT DOCUMENTS

| | | | |
|---|---|---|---|
| 2,551,780 | 5/1951 | Wood | 206/315.6 X |
| 3,101,108 | 8/1963 | Ingoldt . | |
| 3,554,255 | 1/1971 | Mangan | 206/315.6 |
| 3,603,368 | 9/1971 | Brenner . | |
| 3,664,399 | 5/1972 | Neff . | |
| 3,729,036 | 4/1973 | McFadden . | |
| 3,967,667 | 7/1976 | Robinson . | |
| 3,985,229 | 10/1976 | Maki . | |
| 4,173,241 | 11/1979 | Stock . | |
| 4,194,547 | 3/1980 | Sidor et al. . | |
| 4,195,676 | 4/1980 | Hagg et al. . | |
| 4,241,774 | 12/1980 | Pell . | |
| 4,304,278 | 12/1981 | Ruhlandt . | |
| 4,497,404 | 2/1985 | Lowrance | 150/160 X |
| 4,662,415 | 5/1987 | Proutt . | |
| 4,746,014 | 5/1988 | Very | 206/315.6 |

*Primary Examiner*—William Price

*Attorney, Agent, or Firm*—Gifford, Groh, Sprinkle, Patmore and Anderson

[57] ABSTRACT

A golf club protector for protecting the shaft of a golf club including a golf club housing tube having a protective interior and a protective collar provided at the upper end of the tube. Alternatively, an optional protective sleeve insertable within the tube having a protective collar attached thereto may be removably provided as a unit for a conventional tube. Where the housing tube includes a fixed collar and protective interior, the length of the tube may be predetermined in accordance with the length of a particular club shaft, or the tube may be provided with spaced apart cut markings at its lower end to facilitate shortening of the tube by the consumer.

25 Claims, 1 Drawing Sheet

PROTECTIVE TUBE FOR A GOLF CLUB SHAFT

BACKGROUND OF THE INVENTION

I. Field of the Invention

The present invention relates generally to protective devices for golf clubs. More particularly, the s present invention relates to a golf club tube for protecting a golf club shaft having a protective collar and a protective inner liner.

II. Description of the Relevant Art

Equipment employed in the game of golf typically includes primarily a set of clubs, a bag for holding the clubs, an abundance of balls, depending upon the skill (or fortune) of the golfer, and a number of tees.

Insertion into and removal of the clubs from the bag is often awkward and difficult because of the tendency of the clubs, particularly the club handles, to rub against and drag on one another. In an effort to overcome this structural disadvantage, plastic golf club tubes have been provided to be loosely inserted within a golf bag. The golf clubs are then removably inserted into the tubes. The tubes accordingly provide some element of organization.

However, because the tubes are directed at facilitating ease of golf club removal and insertion, the tubes themselves are usually subject to disorganization. Efforts have been made to organize the tubes by a support structure typically provided in the form of a deck or a plate having a series of tube-receiving apertures defined therein.

This response has been more or less useful in providing storage and organization for conventional golf clubs.

However, technological advancements in the design and materials of golf clubs have dictated additional considerations related to the protection of the clubs.

Specifically, club shafts are now commonly composed of graphite. This material provides the club with increased rigidity, improved weight distribution and significant weight reduction.

While graphite composition offers these significant improvements, it suffers from a unique disadvantage in that it is scratched or marred easily. Beyond the fact that this damage may affect the structural integrity of the shaft, the scratching or marring also compromises the shaft's aesthetic appeal. Considering the relatively high expense of graphite-shafted clubs which may be up to four times the cost of conventionally-shafted clubs, there is a high interest in maintaining a desirable appearance of the club shaft.

Use of commonly-provided club tubes, however, does little to prevent the shaft from becoming marred or scratched. When the graphite-shafted club is withdrawn from and reinserted into the conventional tube, scratching and marring result. Such damage may also occur from the movement and shifting of other clubs in the golf bag. This is particularly the case because conventional golf club tubes are of one standard length, thereby leaving a part of the club shaft exposed to damage from other clubs.

Accordingly, prior approaches to solving the problem of preserving the finish of the graphite-shafted clubs have failed. A system for preventing such marring and scratching is desired to protect the golfer's most costly investment.

SUMMARY OF THE PRESENT INVENTION

The present invention provides a golf club protector for protecting the shaft of a golf club, particularly a graphite-shafted club. While this protection is generally directed at protecting clubs as they are present in a golf club bag, the protector of the present invention may also act to protect clubs during shipment or storage. The protector includes a golf club housing tube having a protective interior and a protective collar.

The protector according to the present invention is preferably a one-pieced protector wherein the inner wall of the tube is covered by a protective layer of material terminating at a protective collar provided at the uppermost end of the protector. The collar is composed of a protective material provided within and without the upper end of the tube. The protective layer of the inner wall may be a lining placed thereon or may be formed as part of the tube whereby the tube has a hard, smooth exterior and a soft napped interior, both surfaces being molded simultaneously.

Alternatively, the protector may be an insertable collar and optional sleeve unit that is removably attachable to a conventional golf club tube. If this embodiment is employed, the collar may include an elastic strap for externally fitting to the upper end of the tube. The sleeve itself may be the full length of the tube, or may only be a partial length of the tube, extending downward from the upper end of the tube. The bottom end of the sleeve may be connected to the end of the tube by hooks or other fasteners.

In a modification of this embodiment the collar may be fixed to an intermediate tube that is itself attachable to the top end of the tube. The intermediate tubes may be provided in a variety of lengths whereby different length clubs may be accomodated.

Optionally, the sleeve may include an adhesive for adhesion to the inner wall of the tube.

In either construction the tube may have spaced apart cut markings radially defined at the lower end of the tube. These markings provide places at which the tube may be cut by the consumer to a desired length, which is preferably the length of the club as measured from the end of the club handle to the hosel.

With this preferred length as a guide, the protector may be simultaneously sold with a club thereby personalizing the tube to the club. To this end, the club manufacturer may produce or supply both the tube and the club.

Either embodiment offers the advantage of having a protective tube that is personalized to the length of the club to thereby minimize damage from other clubs and from marring from contact with coarse surfaces.

This personalized construction provides maximum protection for any length of club, whether a wood or an iron or a man's club or a woman's club.

In either construction, the protector may be inexpensively manufactured.

Other advantages and features of the present invention will become more apparent from the following detailed description when read in conjunction with the accompanying drawings.

BRIEF DESCRIPTION OF THE DRAWING

The present invention will be more fully understood by reference to the following detailed description of the preferred embodiments of the present invention when read in conjunction with the accompanying drawing in which like reference characters refer to like parts throughout the views, and in which.

DETAILED DESCRIPTION OF THE PREFERRED EMBODIMENTS OF THE PRESENT INVENTION

Figure 1:
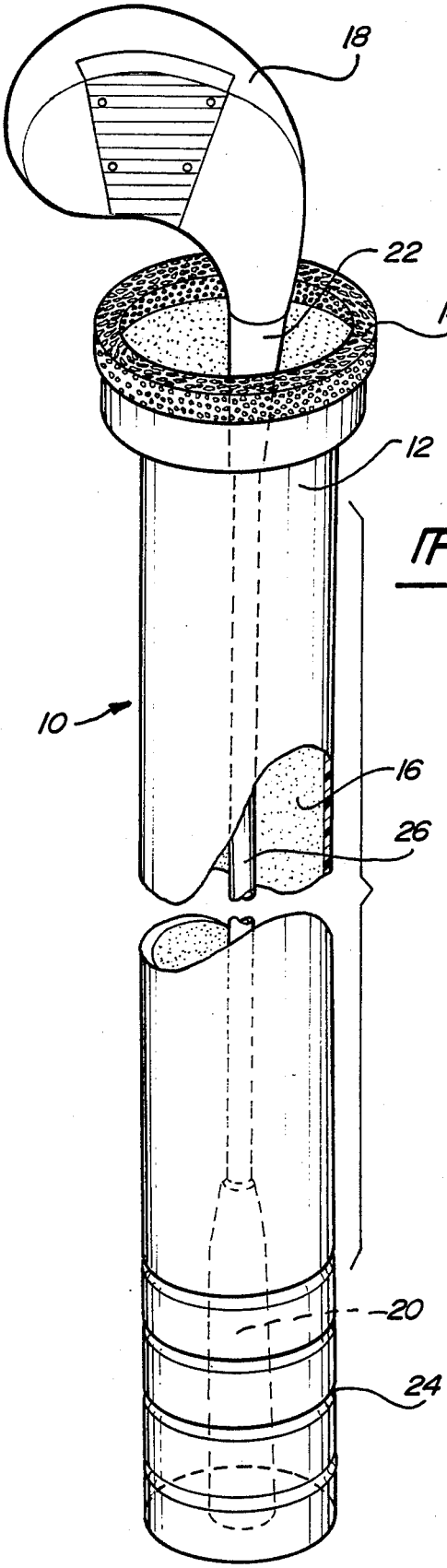
FIG. 1 is a peripheral, partially sectional view of a preferred embodiment of a protector for golf club shafts according to the present invention illustrating further a golf club in broken lines.

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, a preferred embodiment of a golf club shaft protector according to the present invention is illustrated generally as 10. The protector 10 includes a tube 12, a collar portiOn 14, and a protective liner 16. The protector 10 allows for the removable insertion of a club 18. While the protector 10 according to the present invention may be used for protecting any type of club 18 including irons or woods, the protector 10 is preferably for use with a club 18 having a shaft 26 composed of graphite, although other types of clubs (steel shafted being the most common) are usable. In fact, the protector 10 may be used in the protection of any club shaft composed of any material, particularly those requiring special care. The protector 10 is primarily directed at protecting clubs 18 having shafts composed of graphite from being scratched or marred as they are withdrawn from or inserted into the protector 10. Conventional golf club tubes scratch or mar the shaft 26 of the club 18 in that such tubes were not designed to house clubs having graphite shafts.

The tube 12 of the protector 10 is preferably composed of a polymerized material such as a plastic, although other materials may be used.

The tube 12 is of such a length so that when the end of a handle or grip 20 (shown in broken lines) of the club 18 rests on the bottom of the golf bag (not shown), the hosel 22 of the club 18 is approximately level with the collar portion 14.

The protector 10 may be provided by the manufacturer of the club 18, thus allowing the length of the tube 12 to be personalized to the particular club 18. In this way the proper handle-to-hosel length may be achieved.

Conversely, the protector 10 may be supplied independent of the club 18. When this is the preferred marketing approach, the lower end of the tube 12 may have radially defined thereabout one or more cut-markings 24. The markings 24 define possible lengths to which the consumer may cut the tube 12 so as to achieve the preferred handle-to-hosel length. The markings 24 need not be exactly fitted to the length of a given club 26 in that the club's hosel 22 is of sufficient length to allow some variation in the length of the tube 12.

The collar portion 14 is important in achieving the scratch- and mar-proof qualities of the protector 10. The collar 14 is preferably composed of a resilient polymerized foam or sponge material, although other soft materials may be employed. The padding on the collar 14 is situated both within and without the collar 14 to thereby achieve maximum protection. In cross-section, the collar 14 is of an inverted U-shape.

On the inner wall of the tube 12 of the protector 10 is situated the protective liner 16. The liner 16 preferably lines the entire inner wall of the tube 12 of the protector 10. Like the collar 14, the liner 16 may be composed of a polymerized foamed or sponge material and may either be added to the tube 12 by adhesion or may be formed as part of the tube 12 when the tube is molded. The liner 16 may alternatively be composed of a soft cloth such as velour, felt or mohair. In any selection of material, the object of lining interior of the tube 12 of the protector 10 to provide protection for the shaft 26 of the club 18 is the same. Although protection is principally supplied by the collar 14, the liner 16 enhances such protection.

Figure 2:
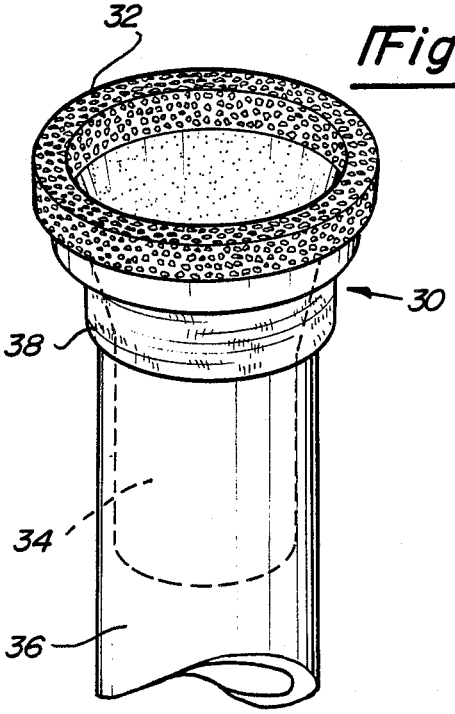
FIG. 2 is a peripheral partial view of another embodiment of the present invention.

With reference to FIG. 2, an alternate embodiment of the present invention is generally illustrate as a protector 30. According to this embodiment, the protector 30 comprises a collar 32 and an optional sleeve portion 34 interconnected with the collar 32. The protector 30 is fittable over a conventional golf club tube 36. To facilitate attachment, the collar 32 includes an integral lower outer elastic band 38, although other means of attachment (including snaps [not shown]) may be employed. According to this embodiment, the protector 30 is removably attachable to the conventional tube 36. In other respects, the collar 32 and the sleeve portion 34 are of similar materials and purpose as are their counterparts of FIG. 1.

Figure 3:
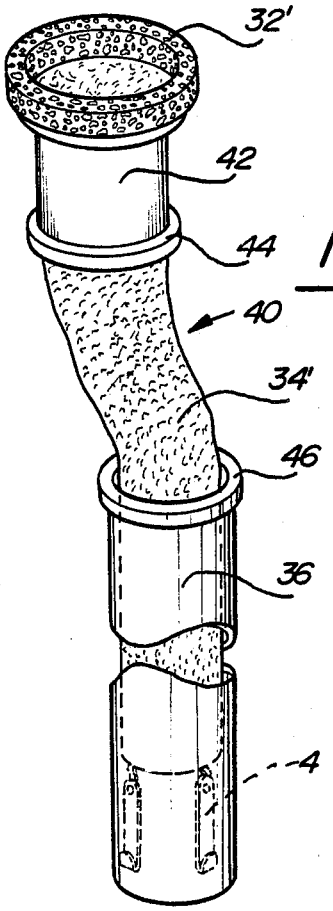
FIG. 3 is a peripheral, partially sectional view of still another embodiment of the present invention showing a protector partially removed from a golf tube.

Turning to FIG. 3, there is shown an alternate embodiment of the protector 30 of FIG. 2, generally illustrated as a protector 40. The protector 40 includes a collar 32' having an intermediate tube body 42 situated thereunder. The tube body 42 includes a tube body snap fastening cap 44 which is snap-fittable over a collar 46 conventionally provided at the top end of the tube 36. Of course, other methods of attaching the body 42 to the tube 36 may be utilized.

According to the embodiment of FIG. 3, because conventional tubes are not provided with any method of shortening the tube for accomodating clubs of different lengths, the intermediate tube body 42 may be provided in different lengths instead. This embodiment allows for the use of different clubs withOut requiring the tube 36 to itself be adjusted.

While the material and purpose of the protector 40 is similar to the protectors 10 and 30 of FIGS. 1 and 2 respectively, the protector 40 includes an elongated sleeve portion 34' for fitting fully into the conventional tube 36. The sleeve portion 34' may fit along substantially the entire length of the tube 36 or may extend partially along the length of the tube 36, even less than half of the length of the tube 36.

Anchoring of the lower end of the sleeve portion 34' is accomplished by a weight (not shown), snap fasteners (not shown) or one or more hooks 4B for removable attachment to the lower end of the tube 36.

Having described my invention, however, many modifications thereto will become apparent to those skilled in the art to which it pertains without deviation from the spirit of the invention as defined by the scope of the appended claims.

I claim:

1. A golf club shaft protector for protecting the shaft of a golf club, said protector comprising:
a tube portion having an upper end and a lower end and an inner wall and an outer wall; and
a collar positioned at said upper end of said tube;
said collar having an inner wall;
at least said inner wall of said collar being substantially covered by a resiliently soft material.

2. The golf club shaft protector of claim 1 wherein said inner wall of said tube portion comprises a protective material.

3. A golf club shaft protector for protecting the shaft of a golf club, said protector comprising:
a tube portion having an upper end and a lower end and an inner wall and an outer wall; and
a collar positioned at said upper end of said tube;
said collar being substantially covered by a resiliently soft material;
said inner wall of said tube portion comprising a protective material;
said protective material being a liner material adhered to said inner wall.

4. A golf club shaft protector for protecting the shaft of a golf club, said protector comprising:
a tube portion having an upper end and a lower end and an inner wall and an outer wall;
a collar positioned at said upper end of said tube;
said collar being substantially covered by a resiliently soft material; and
a sleeve portion interconnected with said collar;
said sleeve portion comprising a soft material;
said sleeve portion being fitted to said inner wall of said tube.

5. The golf club shaft protector of claim 4 wherein said resiliently soft material comprises a polymerized material.

6. The golf club shaft protector of claim 5 wherein said material is a foamed polymerized material.

7. The golf club shaft protector of claim 4 wherein said collar and said sleeve portion are removably fittable to said tube portion.

8. The golf club shaft protector of claim 7 wherein said sleeve portion includes means for anchoring said sleeve to said tube portion.

9. The golf club shaft protector of claim 8 wherein said means for anchoring comprises one or more hooks.

10. The golf club shaft protector of claim 8 wherein in said tube portion is a conventional golf club housing tube.

11. The golf club shaft protector of claim 10 wherein said collar includes an elastic member for being elastically and removably attached to said tube portion.

12. The golf club shaft protector of claim 10 wherein said collar includes an intermediate tube portion, said intermediate tube portion including means for attachment to said conventional housing tube.

13. A golf club shaft protector for protecting the shaft of a golf club, said protector comprising:
a tube portion having an upper end and a lower end and an inner wall and an outer wall; and
a collar positioned at said upper end of said tube;
said collar being substantially covered by a resiliently soft material;
said tube portion including spaced apart radially defined cut markings provided at said outer side of said lower end of said tube portion.

14. The golf club shaft protector according to claim 4 wherein said collar defines an inverted U-shaped member in cross-section.

15. The golf club shaft protector according to claim 4 wherein said protector is provided to be substantially the length of a golf club measured from the tip of its handle to its hosel.

16. The golf club shaft protector according to claim 4 wherein said sleeve portion lines the full length of said inner wall of said tube.

17. The golf club shaft protector according to claim 4 wherein said sleeve portion lines less than half of said inner wall of said tube.

18. A golf club shaft protector for protecting the shaft of a golf club, said protector comprising:
a golf club housing tube having an upper end and a lower end and an inner wall and an outer wall; and
a collar fitted at said upper end of said tube;
said collar including a protective material fitted to said inner wall of said upper end;
said collar further including a protective material fitted to said outer wall of said upper end;
said collar having an inner wall;
said inner wall of said collar being substantially covered by a resiliently soft material.

19. The golf club shaft protector of claim 18 wherein said inner wall of said tube portion comprises a protective material.

20. A golf club shaft protector for protecting the shaft of a golf club, said protector comprising:
a golf club housing tube having an upper end and a lower end and an inner wall and an outer wall; and
a collar fitted at said upper end of said tube;
said collar including a protective material fitted to said inner wall of said upper end;
said collar further including a protective material fitted to said outer wall of said upper end;
said inner wall of said tube portion comprising a protective material;
said protective material being a liner material adhered to said inner wall.

21. A golf club shaft protector for protecting the shaft of a golf club, said protector comprising:
a golf club housing tube having an upper end and a lower end and an inner wall and an outer wall; and
a collar fitted at said upper end of said tube;
said collar fitted at said upper end of said tube;
said collar including a protective material fitted to said inner wall of said upper end; and
said collar further including a protective material fitted to said outer wall of said upper end;
a sleeve portion interconnected with said collar;
said sleeve portion comprising a protective material.

22. The golf club shaft protector according to claim 21 wherein said sleeve portion is fitted to said inner wall of said tube.

23. The golf club shaft protector according to claim 21 wherein said collar and said sleeve portion are removably fittable to said tube portion.

24. A golf club shaft protector for protecting the shaft of a golf club, said protector comprising:
a golf club housing tube having an upper end and a lower end;
a collar positioned at said upper end of said tube;
said collar having an inner wall;
said collar including a protective material adhered at least to said inner wall; and
a sleeve portion interconnected with said collar.

25. The golf club shaft protector of claim 24 wherein said collar and said sleeve portion are removably attachable to said housing tube.

* * * * *

UNITED STATES PATENT AND TRADEMARK OFFICE

CERTIFICATE OF CORRECTION

PATENT NO. : 4,938,349

DATED : July 3, 1990

INVENTOR(S) : PAUL H. BURNS

It is certified that error appears in the above-identified patent and that said Letters Patent is hereby corrected as shown below:

Column 1, line 7, delete "s"

Column 3, line 26, delete "portiOn" and insert --portion--

Column 4, line 21, delete "illustrate" and insert --illustrated-- line 49, delete "withOut" and insert --without-- line 61, delete "4B" and insert --48--

Column 5, line 47, delete "in"

Signed and Sealed this

Tenth Day of September, 1991

*Attest:*

*Attesting Officer*

HARRY F. MANBECK, JR.

*Commissioner of Patents and Trademarks*